United States Patent [19]

Walker et al.

[11] Patent Number: 4,561,661

[45] Date of Patent: Dec. 31, 1985

[54] SOCCER TRAINING DEVICE ESPECIALLY FOR HEAD AND FOOT

[76] Inventors: Leo Walker; Peter Walker, both of Kiergrubenweg 70, 7770 Donaueschingen 75, Fed. Rep. of Germany

[21] Appl. No.: 631,815

[22] Filed: Jul. 17, 1984

[51] Int. Cl.[4] ..... A63B 69/00

[52] U.S. Cl. ..... 273/411; 273/58 C; 273/413

[58] Field of Search ..... 273/411, 413, 200 B, 273/26 E, 29 A, 58 C

[56] References Cited

U.S. PATENT DOCUMENTS

| | | | |
|---|---|---|---|
| 2,213,570 | 9/1940 | Rohland | 273/200 B |
| 3,452,990 | 7/1969 | Nichols | 273/200 B X |
| 3,498,613 | 3/1970 | Dreyer | 273/413 |
| 4,173,340 | 11/1979 | Kanno | 273/413 |
| 4,248,423 | 2/1981 | Lofty | 273/413 X |
| 4,307,888 | 12/1981 | Ohle | 273/413 |

FOREIGN PATENT DOCUMENTS

| | | | |
|---|---|---|---|
| 2351330 | 4/1975 | Fed. Rep. of Germany | 273/413 |
| 725556 | 2/1932 | France | 273/200 B |
| 1162827 | 4/1958 | France | 273/413 |

*Primary Examiner*—William H. Grieb

*Attorney, Agent, or Firm*—Leonard Bloom

[57] ABSTRACT

The soccer training device for head and foot consists of three major parts, i.e. a base support structure, a fiberglass rod, and a ball. The base support structure is designed similarly to parasol stands; however, it possesses a mechanism for continuous height adjustment of the ball and the fiberglass rod. To this mechanism the rod is attached by means of a swing element.

At the tip of the fiberglass rod, the ball is attached to a revolving bearing. The fiberglass rod can have inclinations of approximately 0° to 30°. The fiberglass rod and the swing element serve the purpose of storing potential energy for the return flight of the ball.

The ball is set into motion by the head or the foot of a player, and swings back and forth in an arc section of circular radius.

8 Claims, 9 Drawing Figures

Figure 1:
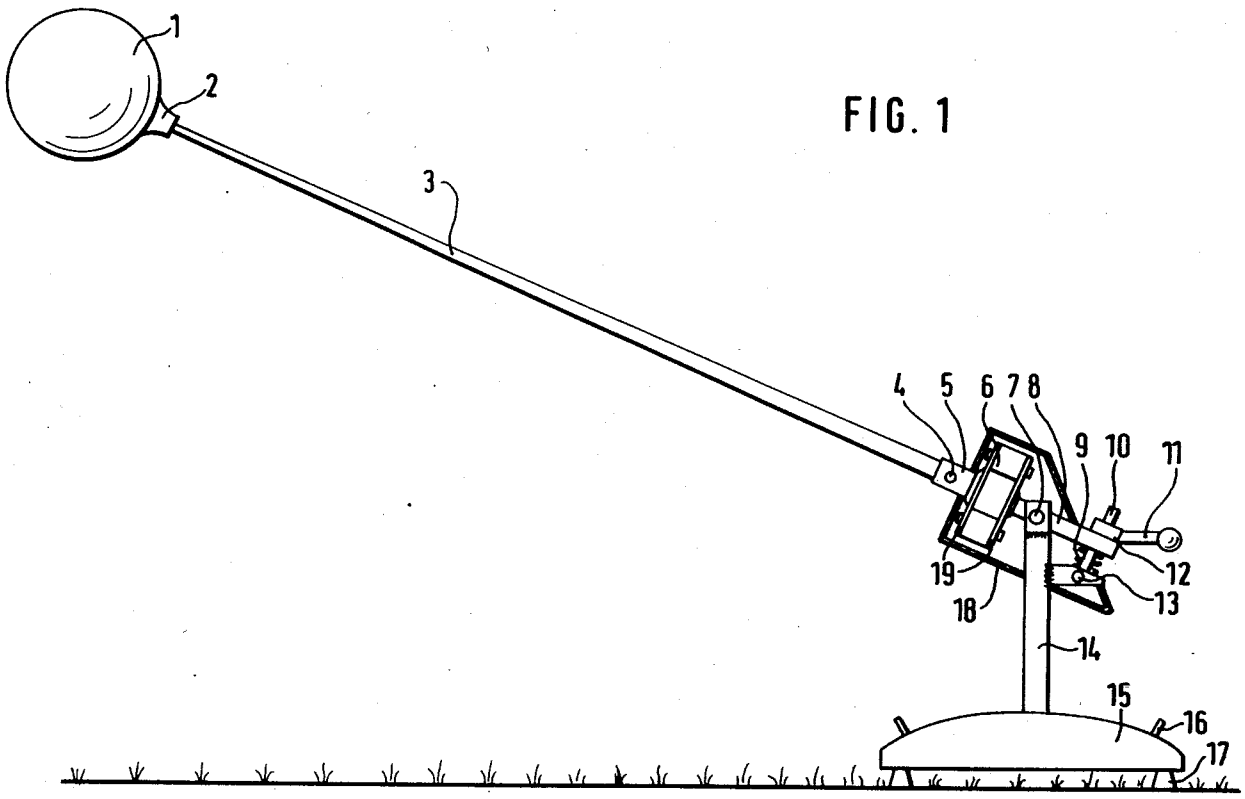

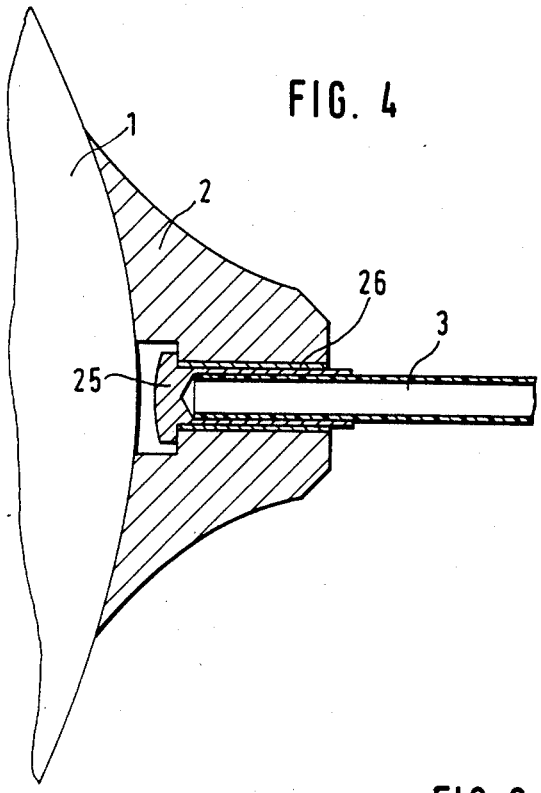
FIG. 4
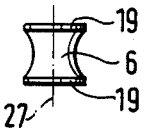
FIG. 5a
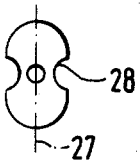
FIG. 5b
FIG. 6a
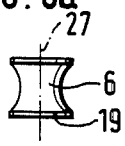
FIG. 6c
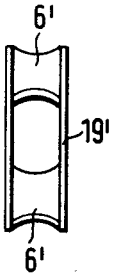
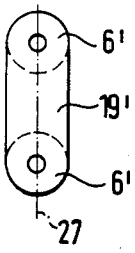
FIG. 6b

SOCCER TRAINING DEVICE ESPECIALLY FOR HEAD AND FOOT

The invention concerns a ball training device.

With devices of this type, which serve the systematic training of ball players (i.e. soccer players), the hit or pushed ball is to be brought back to its initial position, such that a renewed hitting (kicking) or pushing is made possible without the use of an opposing player or helper.

A device for the training of golf is known from U.S. Pat. No. 3,452,990, which in its essentials consists of a ball connected to a short rod which in turn is connected to a base via an elastic element. This golf training device is designed such that a consecutive hit can be made when the ball has been brought into its initial position. For other types of ball playing, in particular for head or football (soccer) training, this device is fundamentally not suited since the ball, as it returns to its initial position, does not follow a path corresponding to a natural projectile motion, such that after the return of the ball to its initial position, a natural behavior of the ball after a consecutive kick (or hit) can not be expected.

A tennis training device is known from U.S. Pat. No. 4,173,340, which also consists of a ball connected to a rod which in turn is connected to a base via an elastic bearing. In this device the rod is inelastic, whereas the elastic connector consists preferably of a rubber element in one piece. This type of ball positioning tends to allow vertical oscillations; thus even such an arrangement does not facilitate motion of the ball in a flight path corresponding to natural projectile motion.

This disadvantage is not inherent to the soccer training device U.S. Pat. No. 4,307,888 which consists of a ball attached to a horizontally positioned rod which can be swiveled about a base. With this device the ball executes an exclusively horizontal motion which in no way corresponds to the ballistic flight curve (projectile motion).

The present invention is based on the task to improve the afore-mentioned device such that the behavior of the ball, especially its flight path, before and after being hit with the head or the foot, corresponds to the natural conditions.

This problem is solved by the characteristics of the present invention. The flexible rod and the swing element allow a ballistic flight curve which is largely free of vertical oscillations.

For the natural behavior of a ball constrained in such a fashion it is further important how the ball behaves after the kick-off. If a player hits a freely flying ball eccentrically, then the ball will experience an additional rotational motion about its center of mass.

In order to imitate this motion with the training device, the ball is attached to the rod not rigidly but able to revolve about an axis identical with the rod.

A possibility of a revolving connection is a further object of the invention.

The object of the invention is described in the following examples of execution, which are shown in the attached figures.

The figures show:

FIG. 1: Sideview of the complete training device.

Figure 3:
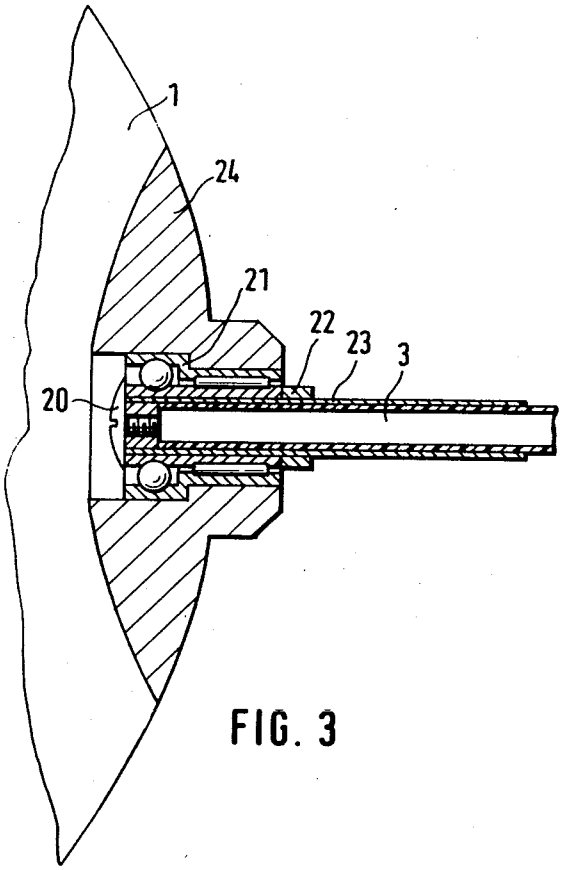
Figure 2:
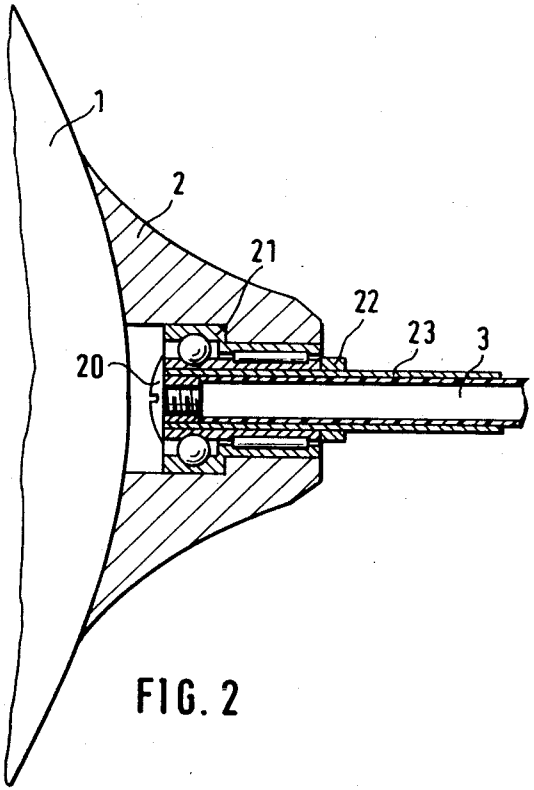

FIGS. 2–4: Enlarged portions of the training device according to FIG. 1 in the connection region between rod and ball, showing three different types.

FIG. 5*a:* Sideview of the swing element according to a first example.

FIG. 5*b:* Top view of the swing element in FIG. 5*a.*

FIG. 6*a:* Side view of the swing element according to a second example.

FIG. 6*b:* Top view of the swing element in FIG. 6*a.*

FIG. 6*c:* Side view of the swing element in FIG. 6*b.*

The training device shown in FIG. 1 consists essentially of a rod 3 which carries at its free end a revolvable ball 1, and which is attached with its other end via a swing element (or resilient coupling) 6,19 to a base 14–17.

The rod 3 is made from an elastic, lightweight and non-breakable material, preferably fiberglass reinforced plastic (or other artificial material). The purpose of the rod is to facilitate a swinging motion, to store the energy for the return of the ball, and to stabilize the direction of flight, i.e., the direction of motion of the ball.

Appropriately, the rod is collapsible to facilitate easy transport.

The rod is inserted into a steel sleeve 5 and held there in a fixed but removable position by a pin or bolt 4. The steel sleeve is attached to the top plate 19 of the swing element 6,19. Opposite the top plate is an identically shaped bottom plate 19 which is (through connector 8) attached to the top end of the base plate-column 14 in such a way as to facilitate rotation about axis 7. The angle of inclination of rod 3, and therefore the height of the ball 1 from the floor, is continuously adjustable between 0 and 250 cm. such that the training device can be used for players of differing height and age groups.

To change the inclination of rod 3, the following adjust mechanism is placed at the base structure: an adjustment screw 10 (threaded bolt), an adjustment lever 11, and a spring 9. The adjustment screw 10 is attached at one end to the base structure 14 by means of a ball joint 13. The other end, onto which the lever 11 is screwed, extends through a transversely drilled opening in conector 8. By rotating lever 11 (about 10) the inclination of the rod 3 can be continuously adjusted within certain limits.

The base structure itself is otherwise designed the same as a conventional parasol stand. Since the device is to be used in field conditions as well as indoors, it is to be portable. This is achieved by attaching handles 16 to the top of the weighted bottom plate 15.

To prevent damage of gymnasium floors, rubber feet 17 are attached to the underside of the weighted bottom plate 15.

The special design of the important swing element 6,19 for the training device is shown in FIGS. 5*a,* 5*b,* and 6*a,* 6*b,* 6*c.* It is the task of the swing element to stabilize the movement of the rod 3 and therefore of the ball 1 in the horizontal direction, thereby damping any vertically occurring jolts or oscillations, and therefore allowing the ball to follow an undisturbed flight path.

In the example of FIGS. 5*a* and 5*b,* the swing element consists of form element 6 (made from rubber) which is held tightly in between top and bottom plates 19.

In the example of FIGS. 6*a* to 6*c* two rubber elements 6′ are placed with axes parallel to each other, and held tightly in between top and bottom plates 19′.

In both versions the elasticity of the rubber elements 6, 6′ is enhanced by a smaller waist. This dimensioning results in a greater elasticity of the swing element perpendicular to the axis 27 than in the direction of axis 27. Through this dimensioning, vertical oscillations are clamped more than horizontal oscillations, which contributes decisively to the stabilization of a mainly horizontally progressing flight path.

Therefore, the flexible rod 3 and the swing element 6, 19 allow an undisturbed flight path as well as a returning of the ball to its initial position. If a player imparts a jab (force) to the ball 1, a swinging motion of rod 3 results which, after reaching its maximum extension, returns the ball 1 on a natural flight path.

To avoid injury of the player, the swing element 6,19 as well as parts of the adjust mechanism 7 to 13 are encapsulated by a cover 18.

At the free end of the rod 3 the ball 1 is attached to a revolving bearing. In FIGS. 2 to 4 three different possibilities of this bearing are demonstrated.

The example of FIG. 2 allows the attachment of a store bought ball 1. To such a ball a bearing housing 2, manufactured from rubber, is attached (e.g. glued etc.). In its central cavity a combination ball-needle bearing 21 is placed whose inner shell rests on the cylindrical sleeve 22, which in turn is rigidly attached to the end of the rod 3. By means of a screw 20 and a safety ring 22, attached to the sleeve 23, the inner shell of the ball bearing 21 is attached firmly to the rod 3, whereas the outer bearing shell is form fitted into the bearing housing 2.

In the example of FIG. 3, a special ball is necessary. Instead of the attached bearing housing 2 in FIG. 2, here an integrated bearing housing 24 is used, which is incorporated into the ball through a stamped-out opening, opposite to the valve of the leather ball, and glued into place.

All the other features are as in FIG. 2.

A simpler but lighter version (due to the lack of ball bearings) is depicted in FIG. 4. Here as in FIG. 2, the bearing housing 2 is attached to the outside of the ball surface.

In this version the outer bearing element consists of a cylindrical shell 26 which is pressed into and attached firmly to the bearing housing 2. The free end of the rod 3 is fitted with a tightly attached cylindrical sleeve 23 which in turn is firmly attached to a cylindrical bearing element 25. This bearing element has a widened top which is stepped on the inside and which overlaps and rides on the inside edge of the cylindrical sleeve 26 within a cavity in the bearing housing.

Other bearing types are possible, e.g. Kalotten bearing, which are not shown here.

The bearings in general allow the ball to revolve with little or no friction about the rod, which imitates the natural behavior.

We claim:

1. A soccer training device comprising, a base, a support member on said base, a ball fastened to a pole, an elastic bearing connecting said pole to said support member for the purpose of returning the ball to its initial position, said pole being a flexible rod, and said elastic bearing having a major axis concentric with respect to the axis of said pole, whereby said elastic bearing steadies the flight path of the ball.

2. A soccer training device according to claim 1, wherein said rod comprises fiberglass materials, and means for disassembling said rod.

3. A soccer training device according to claims 1 or 2, wherein said elastic bearing comprises at least one rubber element disposed between a steel top plate and a bottom plate.

4. A soccer training device according to claim 3, wherein said rubber element is generally cylindrical having a reduced diameter central portion and positioned with its axis parallel to the rod.

5. A soccer training device according to one of the claims 1 through 4, wherein said ball is attached to the rod through a bearing, whereby the ball revolves about the axis of the rod.

6. A soccer training device according to claim 5, wherein the ball comprises a bearing housing having a ball-needle bearing for receiving the free end of the rod.

7. A soccer training device, comprising a base, a support member pivotably mounted on the base for movement about an axis transverse to the base, adjustable clamping means between the support member and the base, whereby the angle of inclination of the support member relative to the base may be varied, thereby providing a height adjustment for the soccer training device, an elongated flexible rod having a longitudinal axis and further having a pair of ends, means including a resilient coupling between the support member and one end of the rod, whereby the rod extends upwardly and outwardly relative to the base, a soccer ball, and means for mounting the ball on the other end of the rod, said mounting means including at least one anti-friction bearing, whereby the ball may rotate freely relative to the axis of the rod, and whereby the resilient coupling steadies the flight path of the ball.

8. A soccer training device, comprising a base, a support member pivotably mounted on the base for movement about an axis transverse to the base, adjustable clamping means between the support member and the base, whereby the angle of inclination of the support member relative to the base may be varied, thereby providing a height adjustment for the soccer training device, an elongated flexible rod having a longitudinal axis and further having a pair of ends, means including a resilient coupling between the support member and one end of the rod, said coupling having a major axis concentric with respect to the axis of said rod, a soccer ball, and means for mounting the ball on the other end of the rod, whereby the resilient coupling steadies the flight path of the ball.

* * * * *